US005235244A

United States Patent [19]

Spindt

[11] Patent Number: 5,235,244

[45] Date of Patent: Aug. 10, 1993

[54] AUTOMATICALLY COLLIMATING ELECTRON BEAM PRODUCING ARRANGEMENT

[75] Inventor: Charles A. Spindt, Menlo Park, Calif.

[73] Assignee: Innovative Display Development Partners, Fremont, Calif.

[21] Appl. No.: 942,361

[22] Filed: Sep. 8, 1992

Related U.S. Application Data

[63] Continuation of Ser. No. 472,338, Jan. 29, 1990, abandoned.

[51] Int. Cl.[5] ..... H01J 19/24; H01J 29/70; H01J 29/18

[52] U.S. Cl. ..... 313/495; 313/308; 313/309; 313/336

[58] Field of Search ..... 313/308, 309, 495, 336, 313/351

[56] References Cited

U.S. PATENT DOCUMENTS

| | | | |
|---|---|---|---|
| 3,665,241 | 5/1972 | Spindt et al. | 313/309 X |
| 3,755,704 | 8/1973 | Spindt et al. | 313/309 |
| 3,789,471 | 2/1974 | Spindt et al. | 445/52 |
| 3,812,559 | 5/1974 | Spindt et al. | 313/309 X |
| 3,921,022 | 11/1975 | Levine | 313/309 |
| 4,020,381 | 4/1977 | Oess et al. | 313/309 X |
| 4,163,949 | 8/1979 | Shelton | 313/351 X |
| 4,498,952 | 2/1985 | Christensen | 313/309 X |
| 4,721,885 | 1/1988 | Brodie | 313/309 X |
| 4,983,878 | 1/1991 | Lee et al. | 313/308 |

*Primary Examiner*—Palmer C. Demeo
*Attorney, Agent, or Firm*—Flehr, Hohbach, Test, Albritton & Herbert

[57] ABSTRACT

An arrangement for and method of automatically collimating an expanding electron beam emitted from a field emission cathode is disclosed herein. This is accomplished without an externally powered colimating or focusing electrode. Rather, a dielectric member is positioned around the path taken by the beam so that when the beam is initially turned on, it bombards the dielectric member with free electrons and thereby places a negative electrostatic charge, ultimately reaching the potential of the cathode electrode itself, on the dielectric member. This electrostatic charge, in turn, causes the cross-sectional configuration of the beam to contract.

7 Claims, 2 Drawing Sheets

AUTOMATICALLY COLLIMATING ELECTRON BEAM PRODUCING ARRANGEMENT

This is a continuation of application Ser. No. 07/472,338 filed Jan. 29, 1990, now abandoned.

FIELD OF THE INVENTION

The present invention relates generally to production of an electron beam using a field emission cathode electrode, and more particularly to a specific technique for causing the cross-sectional configuration of the beam to contract, whereby an outwardly expanding beam can be better collimated.

It is well known in the art to use needlelike field emission cathode electrodes to emit controlled electron beams for use in, for example, flat displays. See, for example, Spindt U.S. Pat. Nos. 3,668,241; 3,755,704; 3,789,471; and 3,812,559 all of which are incorporated herein by reference.

A particular example of the prior art generally, as it relates to the present invention, is illustrated in FIG. 1. Specifically, there is shown a portion of an overall flat display which is generally indicated by the reference numeral 10. This display includes, among other components, one or more needle-like field emission cathodes for each pixel making up the displays screen (not shown). One such cathode electrode is shown at 12 supported on an electrically conductive matrix addressing strip 14, which, itself, is supported on a horizontally extending dielectric substrate 16 such that the cathode electrode extends vertically upward, as shown. A gate anode electrode 18 in the form of a substrate or matrix addressing strip is supported above and in parallel relationship with substrate 16 by means of an intermediate dielectric layer 20. As seen in FIG. 1, anode electrode 18 and dielectric layer 20 together define an aperture 22 concentric with the axis of and containing cathode electrode 12. A target anode electrode 24 forming part of the display's screen is spaced a substantial distance above the gate anode electrode, typically in parallel relationship with substrate 16.

Suitable circuitry, generally indicated at 26, is provided for supplying negative operating voltage to cathode electrode 12 through matrix addressing strip 14 and positive operating voltage to gate anode electrode 18 and target anode electrode 24 so as to cause a beam 28 of electrons to be emitted from the cathode electrode. The positive potential on electrode 24 is sufficiently larger than the positive potential on gate electrode 18 in order to cause beam 28 to pass through aperture 22 as it moves toward target electrode 24.

As prior art display 10 has been described thus far, because cathode electrode 12 in actuality does not define a perfect point, the beam 28 tends to expand outwardly as it passes through the the top end of aperture 22. If left this way, it would impinge on target electrode 24 over a larger area than its own associated pixel, thereby resulting in "cross-talk" between pixels. In order to minimize the expansion of beam 28 and to eliminate this cross-talk, display 10 includes a second, collimating or deflecting gate electrode 30, in the form of an electrically conductive substrate, supported above and in parallel relationship with gate electrode 18 by means of a suitable dielectric layer 32 which electrically insulates the two electrodes from one another. Like electrode 18 and dielectric layer 20, the electrode 30 and dielectric layer 32 include an aperture 34 co-axially aligned with aperture 22. As illustrated in FIG. 1, deflecting electrode 30 is operated at a potential appropriate to the geometry, but typically equal to or more negative than cathode electrode 12, by suitable means forming part of the circuitry 26.

As seen in FIG. 1, electrode 30 serves to deflect diverging beam 28 inward so as to better collimate it and, thereby, eliminate cross-talk between pixels, at the screen of display 10. While this technique functions in a generally satisfactory manner, it does have a number of disadvantages. First, it requires its own power supply for electrode 30, thereby adding to the cost of the overall display. Second, and possibly more important, deflecting electrode 30 adds capacitance to the electrical system required to operate the electrical display. Specifically, without deflecting electrode 30, the only relevant capacitance in the electrical system is the capacitance between cathode electrode 12, actually address strip 14, and gate electrode 18, as indicated at Cl. By adding electrode 30, additional capacitance between that electrode and gate electrode 18 is added to the system, as indicated at C2. It is well known in the art that to cause cathode 12 to emit current, the capacitance in circuit with the cathode must first be charged up. By adding additional capacitance C2, it takes longer to drive cathode 12 to its emission state and it requires more energy for a given power output.

SUMMARY OF THE INVENTION

In view of the foregoing, it is a specific object of the present invention to provide a display of the general type illustrated in prior art FIG. 1 including means for deflecting each of its individual electron beams inward in the manner provided by electrode 30, however without requiring additional capacitance.

A more general object of the present invention is to provide an arrangement for producing a supply of free electrons, for example, in the form of a beam, which arrangement includes means for altering the path of at least some of the electrons such that the altering means functions in a way similar to electrode 30 in FIG. 1, but without the added capacitance.

As will be seen hereinafter, an arrangement for producing a supply of free electrons and specifically an electron beam is disclosed herein. This arrangement includes at least one field emission cathode electrode, means for causing the cathode electrode to emit electrons, for example, a beam, along a particular path, and means consisting essentially of a dielectric material located at a specific location along the path taken by those electrons for altering their path, and in the case of a beam, for contracting the cross-sectional configuration of the beam. As will be seen, this is accomplished by using the free electrons themselves to initially bombard the dielectric material and thereby place a sufficiently large negative electrostatic charge on its surface so that the charged surface actually deflects the subsequent oncoming electrons away from the surface.

BRIEF DESCRIPTION OF THE DRAWINGS

The arrangement disclosed herein will be described in more detail hereinafter in conjunction with the drawing, wherein.

DESCRIPTION OF THE PREFERRED EMBODIMENT

Figure 1:
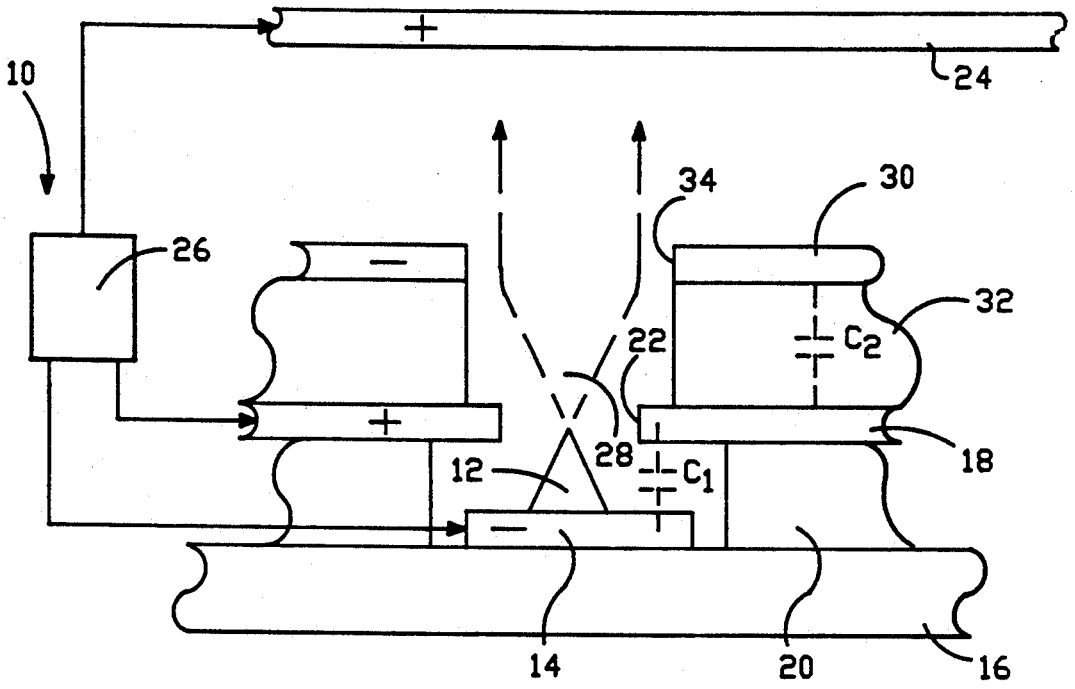
(PRIOR ART) FIG.—1
FIGURE 1 is a diagrammatic illustration of part of a flat display utilizing field emission cathode electrodes in accordance with the prior art.
Figure 2:
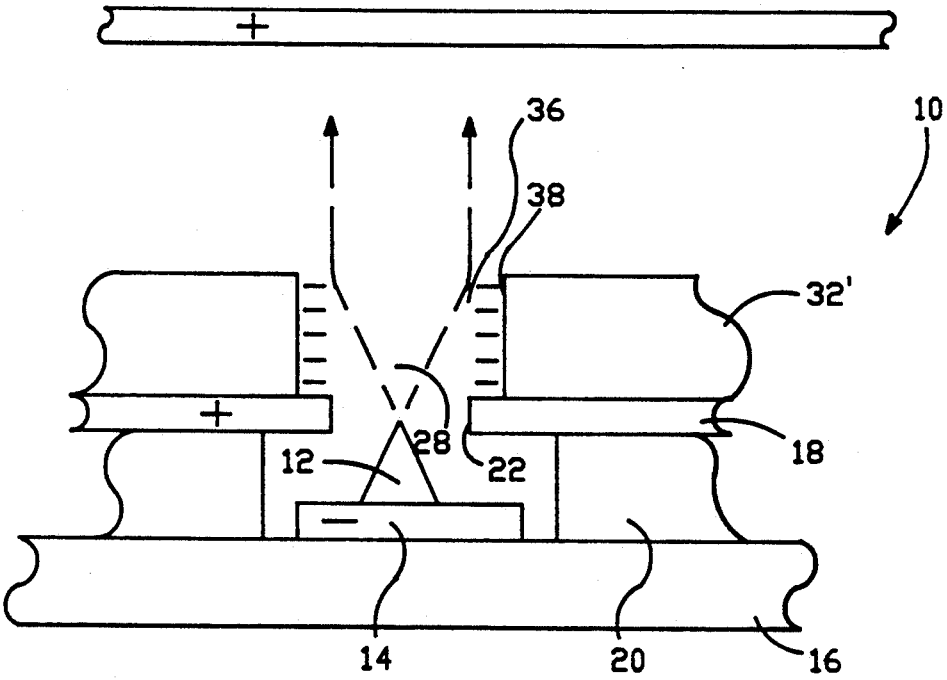
FIG. 2 is a diagrammatic illustration of part of a flat display which also utilizes field emission cathode electrodes but which is made in accordance with the present invention.

Inasmuch as FIG. 1 has already been discussed in detail, attention is immediately directed to FIG. 2 which, as just stated, illustrates part of an overall flat display, generally indicated by the reference numeral 10'. With one and possibly two exceptions, display 10' may be identical to previously described 10. Therefore, like display 10, display 10' includes a needle-like cathode electrode 12 supported on electrically conductive address strip 14 which, in turn, is supported on a suitable dielectric substrate 16. A corresponding gate anode electrode 18 is supported above substrate 16 by means of a dielectric layer 20 and with layer 20, includes a corresponding aperture 22. Display 10' also includes a spaced apart target anode electrode 24. While only one field emission cathode electrode and associated components are shown in FIG. 2, it is to be understood that the display 10', like display 10, includes a large number of such components. Also, while not shown in FIG. 2, the overall display 10', like display 10, include suitable circuitry 26 for supplying operating voltage to the display.

Display 10' differs from display 10 in one and possibly two ways. First, display 10' does not include deflecting electrodes 30 and any associated circuitry required to energize that electrode. Second, while display 10' does include a dielectric layer 32' which may or may not be the same dielectric material as layer 32, layer 32' functions in an entirely different manner. As described above, the sole purpose for dielectric layer 32 is to electrically insulate deflecting electrode 30 from gate electrode 18. The purpose of dielectric layer 32' is, to itself serve as an electron deflector without the need for external power, as will be described immediately below.

As illustrated in FIG. 2, dielectric layer 32' includes its own through-opening 36 defined by a circumferential rim 38. Note that circumferential rim 38 concentrically circumscribes the axis of cathode electrode 12 and therefore the axis of beam 28. Note further that this circumferential rim is in direct line with the outer edge of beam 28 as it expands outwardly from cathode electrode 12. As a result, when cathode electrode 12 is first turned on, it is caused to emit electrons, many of which bombard rim 38. The specific dielectric material comprising layer 32' is selected such that the bombarding electrons place a sufficiently large negative electrostatic charge on rim 38 so that the charged rim deflects electron beam 28 inward as it passes through opening 36, whereby to contract the cross sectional configuration of the beam at that point and thereby collimate it in the same manner as electrode 34, but without adding further capacitance.

In order for dielectric layer 32' to function in the manner just described, its first crossover voltage for secondary electron emission must be higher than the emission voltage in cathode 12. In that way, as the rim 38 of layer 32' is bombarded by electrons, more electrons will remain on the rim than are removed by means of secondary emission, thereby statically charging the rim to a negative potential which ultimately reaches that of the cathode electrode itself. This electrostatic charge serves the same function as deflecting electrode 30, that is, to cause the subsequent oncoming electrons to be deflected inward.

Figure 3:
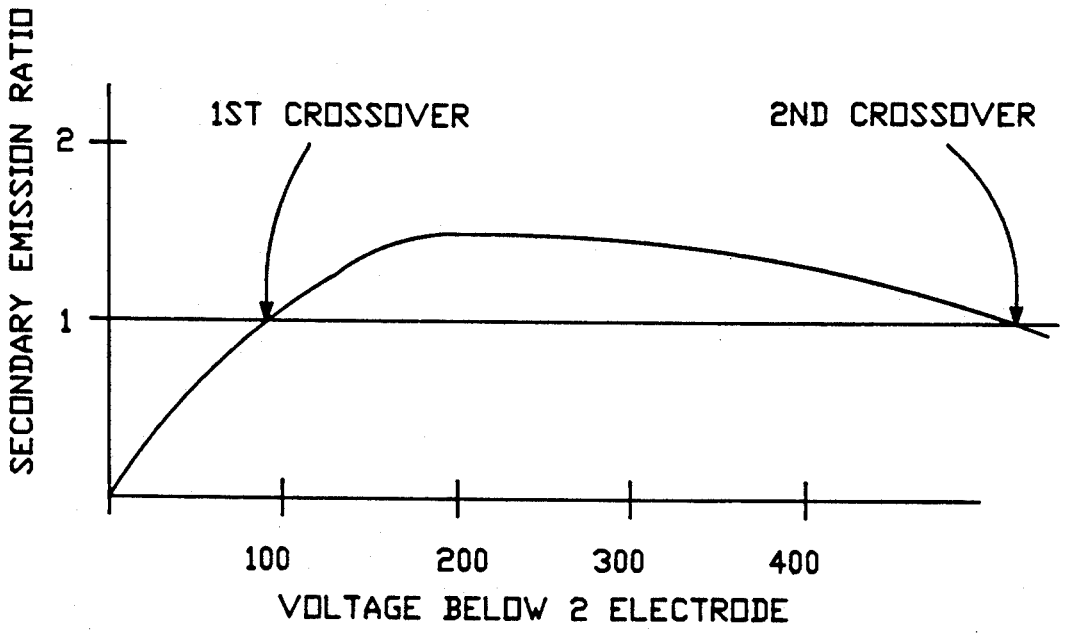
FIG. 3 graphically depicts the functional relationship between secondary electron emission and voltage for given materials.

In view of the teaching herein, one with ordinary skill in the art could select the appropriate material making up dielectric layer 32' to function in the manner described above. For example, one such material is silicon dioxide. However, FIG. 3 depicts a graph which is helpful in selecting the appropriate material. This graph illustrates the secondary emission ratio of a given material as a function of voltage between two electrodes. Note specifically that as the voltage increases, the secondary emission ratio increases to a value of one at a first crossover point and then eventually decreases back down to a ratio of one at a second cross over point. What this means is that below the first crossover point, that is, below a certain voltage difference between the two electrodes, more electrons are added to the surface being bombarded than are actually emitted therefrom by means of secondary emission. Therefore, such a surface would continue to charge up negative until the voltage difference reaches the level where the first crossover point is passed, at which time the surface begins to charge positive due to the loss of more electrons from the surface than are actually captured. Thus, the material making up dielectric layer 32' should be selected to display a secondary emission ratio below its first crossover point at the particular operating voltage of cathode 12.

With regard to both FIGS. 1 and 2, it should be understood that the dimensions illustrated have been exaggerated in order to more clearly illustrate the various components. In actuality, the various components are quite small or thin. For example, cathode electrode 12 is approximately 1 μm high, electrode 18 is 0.3 μm thick, and dielectric layer 32' is approximately 2 μm.

The dimensions just provided are for purposes of illustration only and are not intended to limit the present invention. In fact, it is to be understood that the present invention is not limited to flat displays but could be incorporated into other devices or structures that require contracting or otherwise altering the configuration of free electrons generally. In all of these cases, the dielectric material itself is utilized as an electron deflector by charging its appropriate surface in the manner described.

What is claimed is:

1. A self collimating electron beam producing arrangement, comprising:

(a) a first horizontally extending dielectric substrate including a conductive matrix address strip supporting a vertically upwardly extending needle-like field emission cathode electrode;

(b) a gate anode electrode in the form of a conductive matrix address strip on a second dielectric substrate and including a aperture therethrough, said second substrate being disposed in parallel spaced apart relationship above said first dielectric substrate such that said cathode electrode extends into said aperture;

(c) a target anode electrode spaced above said second substrate;

(d) means for supplying operating voltage to each of said electrodes so as to cause a beam of electrons to be emitted from said cathode electrode and move through said aperture towards said target anode electrode; and (e) means for contracting the cross-sectional configuration of said electron beam immediately above the aperture in said matrix address strip on said second dielectric substrate forming said gate anode electrode, said path altering means consisting essentially of a third substrate disposed on top of said second substrate and spaced from said target anode electrode throughout its extent, said third substrate including a through-hole positioned in coaxial relationship with the aperture in said matrix address strip on said second substrate such that the rim of the hole through said third substrate is initially bombarded by electrons emitted from said cathode electrode when the latter is initially caused to emit said electron beam, at least the rim of said third substrate consisting essentially of a dielectric material which will charge up negatively as a result of the initial bombardment of said electrons from said cathode electrode to a degree sufficient to deflect all subsequent oncoming electrons from said cathode electrode and thereby cause the cross-sectional configuration of the beam to contract within the dielectric rim.

2. A self collimating electron beam producing arrangement, comprising:

(a) a first horizontally extending dielectric substrate including conductive matrix address strip means supporting a plurality of closely spaced vertically upwardly extending needle-like field emission cathode electrodes;

(b) a gate anode electrode in the form of conductive matrix address strip means on a second dielectric substrate and including a aperture therethrough for each of said cathode electrodes, said second dielectric substrate being disposed in parallel spaced apart relationship above said first substrate such that each of said cathode electrodes extends into an associated one of said apertures;

(c) a target anode electrode spaced above said second substrate;

(d) means for supplying operating voltage to each of said electrodes so as to cause a beam of electrons to be emitted from each of said cathode electrode and move through its associated aperture towards said target anode electrode in a controlled manner; and (e) means for contracting the cross-sectional configuration of each of said electron beams immediately above its associated aperture gate, said path altering means consisting essentially of a third substrate disposed on top of said second substrate and spaced from said target anode electrode throughout its extent, said third substrate including a through-hole positioned in coaxial relationship with each of said apertures such that the rim of each of the holes through said third substrate is initially bombarded by electrons emitted from its associated cathode electrode when the latter is initially caused to emit said electron beam, at least each of the rims of said third substrate consisting essentially of a dielectric material which will charge up negatively as a result of the initial bombardment of said electrons from its associated cathode electrode to a degree sufficient to deflect all subsequent oncoming electrons from its associated said cathode electrode and thereby cause the cross-sectional configuration of the associated beam to contact within the dielectric rim.

3. An improvement in a display system having matrix of electron emissive structures associated with a matrix of pixels formed upon a screen element, wherein each electron emissive structure includes at least one field emission cathode structure including a field emission cathode electrode, a gate electrode in close proximity to but spaced from said cathode electrode by a dielectric substrate, a target anode electrode spaced a further distance from said cathode electrode than said gate electrode and disposed over the extent of said screen element, means for supplying operating voltage to each of said electrodes so as to cause electrons to be emitted from said cathode electrode and move toward said target anode electrode and impact a pixel associated with said cathode structure to produce light, each electron emissive structure being addressable by a conductive matrix to selectively illuminate each associated pixel, wherein the improvement comprises:

means for altering the path of at least some of said electrons as they move from said cathode electrode toward said target anode electrode, said path altering means being supported by said gate electrode and said dielectric substrate and spaced from said target anode electrode over its entire extent, and positioned with respect to each of said electrodes such that it is initially bombarded by electrons emitted from said cathode electrode when the latter is initially caused to emit electrons, said path altering means consisting essentially of a dielectric material which will charge up negatively by the initial bombardment of electrons from said cathode electrode to a degree sufficient to deflect most subsequent oncoming electrons from said cathode electrode and thereby alter their paths of movement toward said target anode electrode and said associated pixel.

4. An arrangement according to claim 3 wherein said cathode, gate and target anode electrodes and said operating voltage supply means are designed so that electrons emitted from said cathode electrode form a beam of electrons extending from said cathode electrode toward said target anode electrode, and wherein said dielectric path altering means deflects the electrons forming said beams in a way which contracts its cross-sectional configuration.

5. An arrangement according to claim 4 wherein said cathode electrode includes a single needle-like electrode structure having a vertically upwardly directed point, said gate anode electrode extends circumferentially around said point of said cathode electrode, and said dielectric path altering means is located in close proximity to said gate electrode and spaced from said target anode electrode throughout its extent.

6. An arrangement according to claim 5 including a first horizontal dielectric substrate supporting said needle-like cathode electrode, wherein said gate electrode is disposed upon a second horizontal dielectric substrate having an aperture therethrough, said second dielectric substrate being disposed above and parallel with said first dielectric substrate such that the point of said cathode electrode is concentric with and extends into said aperture, and wherein said dielectric path altering means is in the form of a dielectric substrate having an aperture therethrough, said dielectric substrate being disposed on said second substrate such that their apertures are concentric with one another.

7. An arrangement according to claim 6 wherein said dielectric substrate forming said path altering means is silicon dioxide.

* * * * *